US007344024B2

(12) United States Patent
Focke et al.

(10) Patent No.: US 7,344,024 B2
(45) Date of Patent: Mar. 18, 2008

(54) CIGARETTE PACKAGING, METHOD AND DEVICE FOR THE PRODUCTION THEREOF

(75) Inventors: Heinz Focke, deceased, late of Verden (DE); by Jürgen Focke, legal representative, Verden (DE); Hans-Jürgen Bretthauer, Bremen (DE); Henry Buse, Visselhövede (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 502 days.

(21) Appl. No.: 10/470,500

(22) PCT Filed: Jan. 3, 2002

(86) PCT No.: PCT/EP02/00010

§ 371 (c)(1),
(2), (4) Date: Feb. 26, 2004

(87) PCT Pub. No.: WO02/060784

PCT Pub. Date: Aug. 8, 2002

(65) Prior Publication Data

US 2004/0140234 A1 Jul. 22, 2004

(30) Foreign Application Priority Data

Jan. 30, 2001 (DE) ..... 101 04 301

(51) Int. Cl.
*B65D 85/10* (2006.01)

(52) U.S. Cl. ..... 206/271; 206/813

(58) Field of Classification Search ..... 206/271, 206/273, 274, 242, 245, 813; 229/87.12, 229/87.13, 87.14, 160.1, 198.2; D27/186
See application file for complete search history.

(56) References Cited

U.S. PATENT DOCUMENTS

| | | | | |
|---|---|---|---|---|
| 2,564,099 | A * | 8/1951 | Dunning | 229/132 |
| 4,508,218 | A | 4/1985 | Focke et al. | |
| 5,762,186 | A | 6/1998 | Focke et al. | |
| 6,070,790 | A * | 6/2000 | Anderson | 229/134 |
| 6,494,317 | B1 * | 12/2002 | Focke | 206/271 |

FOREIGN PATENT DOCUMENTS

| | | |
|---|---|---|
| DE | 198 31 621 A1 | 1/2000 |
| JP | 58-11674 | 1/1983 |
| JP | 2002-523303 | 7/2002 |
| WO | WO 00/10877 A2 | 3/2000 |

* cited by examiner

*Primary Examiner*—J. Gregory Pickett
(74) *Attorney, Agent, or Firm*—Sughrue Mion, PLLC

(57) ABSTRACT

In the case of a (soft) pack for cigarettes, the blank (10) made of paper or similar material is provided, adjacent to an end wall (16), with a multi-layered folding strip (21) running all the way round. In order that inner layers can be connected to outer, covering layers via glue—spot of glue (20)—a round cutout (29) made by punching is provided, the spot of glue (20) being positioned in the region of said cutout. A special feature is constituted by the production of blanks (10) for such a pack.

6 Claims, 4 Drawing Sheets

10
28
21
29
31
23
31
38

33
29
31
21
29
31
38
34
34
29/31
33

33
21
30
34
29
32

33
31
36
31
35
33

CIGARETTE PACKAGING, METHOD AND DEVICE FOR THE PRODUCTION THEREOF

BACKGROUND OF THE INVENTION.

The invention relates to a pack, in particular cigarette pack, having at least one blank which encloses the pack contents, is made of foldable packaging material, such as paper, film, cardboard or the like, is of multi-layered design in a sub-region and, as a result of folding, has a border-side overlap, an inner folding tab being connected to an outer folding tab by glue and the glue passing through a cutout in an intermediate tab. The invention also relates to a process for producing packs and to an apparatus for carrying out the process.

The invention deals predominantly with packs configured as in WO 00/10877. In the case of this pack, which comprises a single blank made of paper or the like, a multi-layered folding strip, namely one which is formed on account of a Z-shaped fold, is arranged adjacent to an end wall. In the region of a narrow, upright side wall, there is also overlapping of the Z-fold. A cutout, which in the exemplary embodiment is triangular, is formed in the case of the known pack, and this makes is possible for an outer tab of the fold to be connected to an inner tab by glue, the glue being located in the region of a cutout in intermediate tabs.

SUMMARY OF THE INVENTION.

The object of the invention is to develop further, and improve, packs of the type mentioned in the introduction, in particular to improve the configuration and production of cigarette packs configured as in WO 00/10877.

In order to achieve this object, the pack according to the invention is characterized in that the formation in the blank or in the intermediate tab is bounded by a punch cut which is rounded overall.

A round, in particular elongate, for example (more or less) oval punch cut provides an opening or cutout which is favourable in respect of the tearing behaviour. Furthermore, such a cutout or opening can be easily produced by an appropriate punching tool.

A further special feature is that the piece of material formed during punching, rather than being disposed of as waste, is joined to the blank via residual connection and removed from the region of the cutout by being folded over.

There is a specific process for producing packs or blanks with multi-layered folding strips. According to the invention, the procedure is such that the cutout is made by punching in a continuous material web for the production of the blanks and, thereafter, the folding strip, which runs in the longitudinal direction of the web, is formed in the region of the successive cutouts. Finally, the blanks are severed from the material web, provided with cutouts and folding strip, the transversely directed severing cut preferably being made in the region of the cutout in order reliably to avoid the severing cut being offset outside the region of the border-side cutout.

If the punched segment remains connected to the material web via residual connections, the punched segment is rendered upright by a specific measure, namely by material web being deflected, with the result that it can be folded over by a, for example, stationary folding element.

BRIEF DESCRIPTION OF THE DRAWINGS.

Further special features of the invention are explained in more detail hereinbelow with reference to the drawings, in which.

Figure 2:
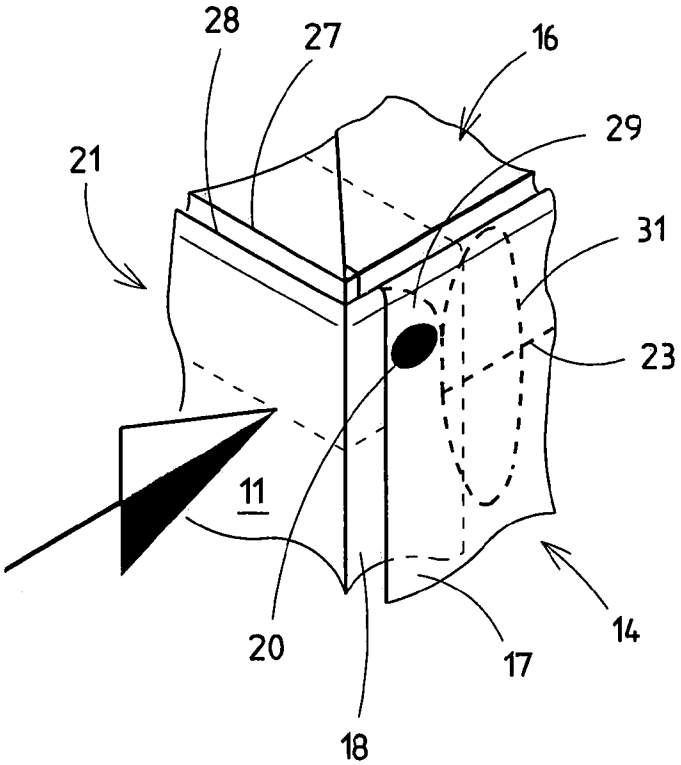
FIG. 2 shows, on an enlarged scale, a top, end region of the pack according to FIG. 1.
Figure 1:
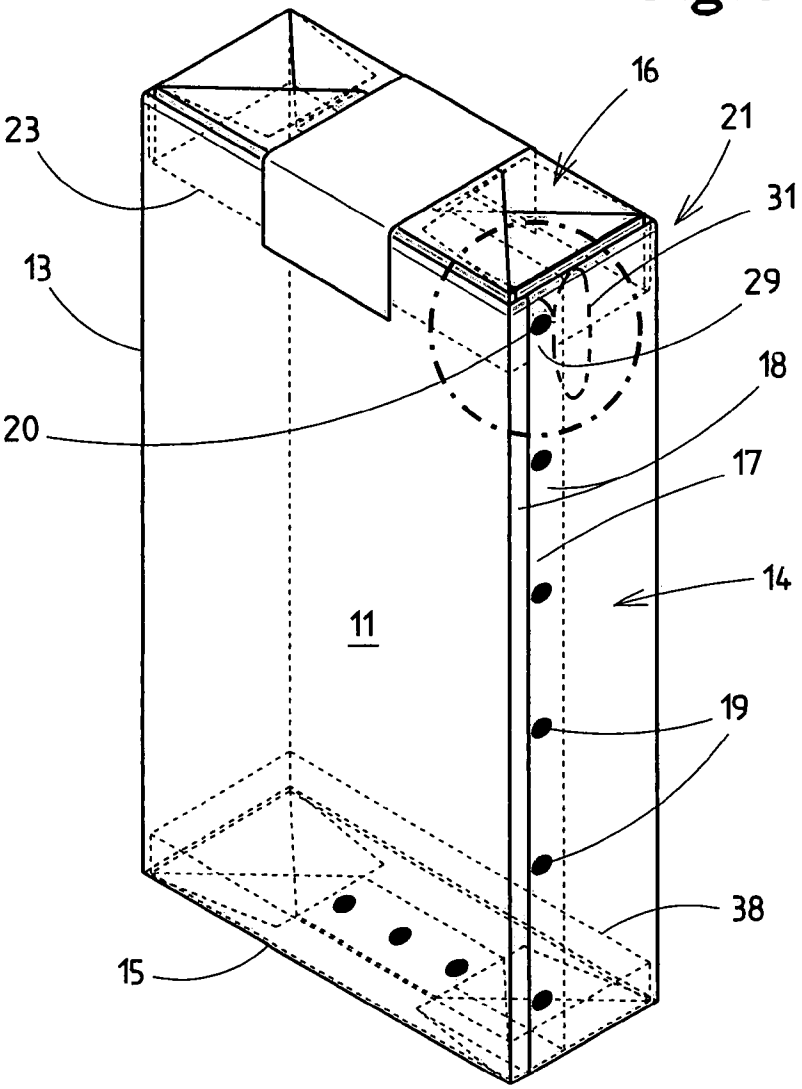
FIG. 1 shows a perspective view of a cigarette pack.
Figure 4:
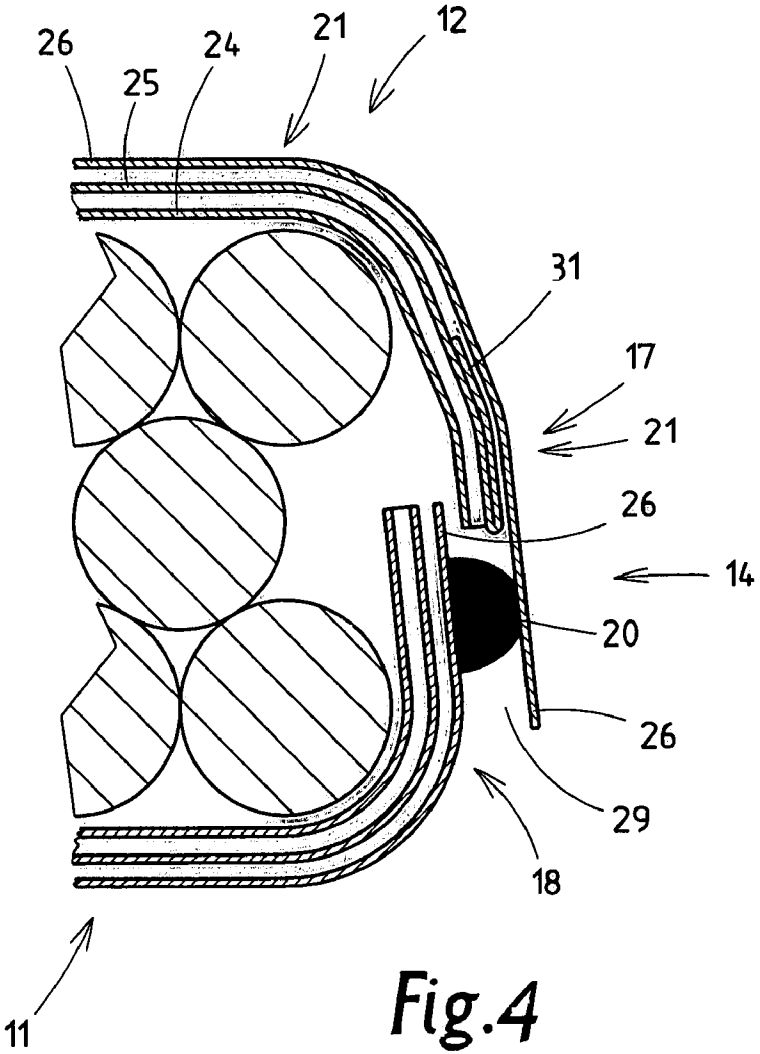
FIG. 4 shows a horizontal section through the detail according to FIG. 3, along section plane IV-IV.
Figure 3:
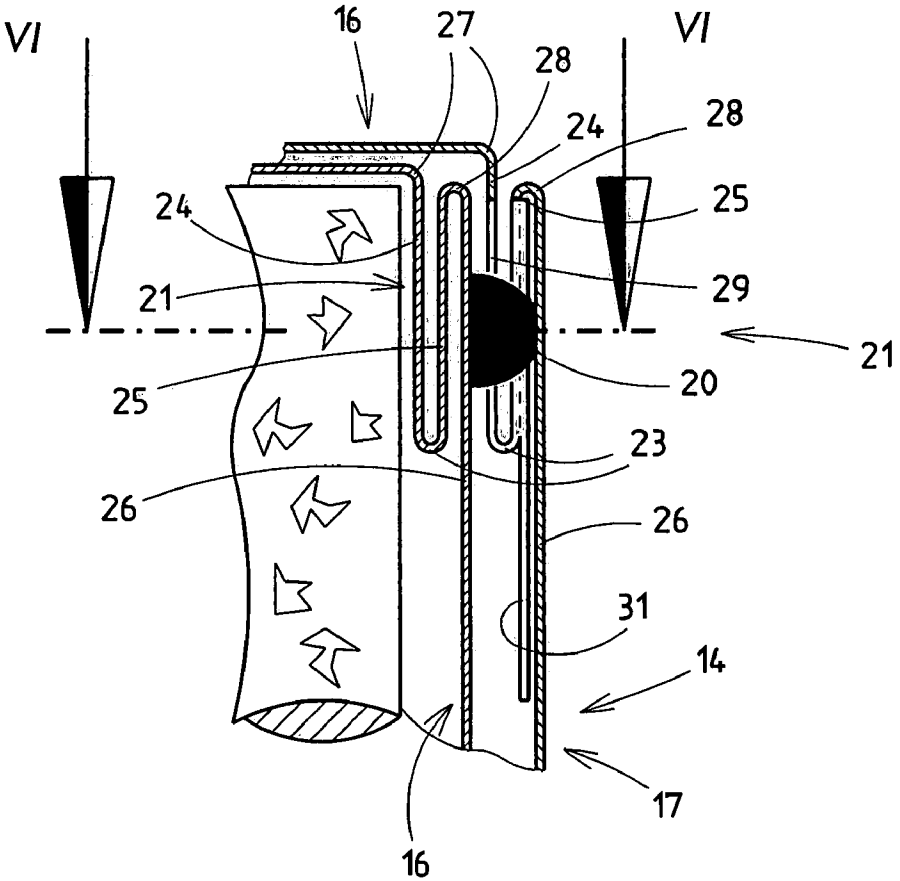
FIG. 3 shows, on a further-enlarged scale, a vertical section through a top, end corner region of the pack according to FIG. 1.

DETAILED DESCRIPTION OF THE INVENTION.

The drawings deal with a (cigarette) pack essentially configured as in WO 00/10877. The cuboidal pack comprises a blank 10 made of paper or paper-like material. The cuboidal pack forms a large-surface-area front wall 11, a rear wall 12 located opposite the front wall, two narrow upright side walls 13, 14 and a base wall 15 and end wall 16.

The side wall 14 comprises two overlapping border strips of the blank 10, namely a (relatively wide) outer strip 17 and a relatively narrow inner strip 18. The outer strip 17 and inner strip 18 are connected to one another, to be precise by adhesive bonding, specifically by spots of glue 19, 20, in order to form the side wall 14.

The pack or the blank 10 thereof has a folding strip all the way round, to be precise a Z-fold strip 21. This is formed by a blank strip 22 being folded in a Z-shaped manner. This blank strip is folded along an approximately central Z-fold edge 23 such that three layers of the blank 10 are located against one another in the region of the Z-fold strip 21. These three. layers are formed by an inner tab or inner leg 24, by an intermediate tab or intermediate leg 25 and by an outer tab or outer leg 26. The relevant legs or material strips of the Z-fold strip 21 are bounded, on the one hand, by the Z-fold edge 23 and, on the other hand, by folding lines 27 as a transition into the end wall 16 and/or by a folding line 28 as the transition into the outer leg 26. The latter is respectively the top part of front wall 11, rear wall 12 and side walls 13 and 14.

In order to connect the border strips, namely outer strip 17 and inner strip 18, the spots of glue 19, 20 are spaced apart from one another on the outside of the inner strip 18. The top spot of glue 20 is located in the region of the Z-fold strip 21 and is intended to connect the inner strip 18 to the outer strip 17. In order to overcome the problem presented by multi-layered construction, the outer strip 17 is provided, in the region of the Z-fold strip 21, with a cutout 29 which is positioned and designed such that the spot of glue 20 produces a connection between the outer leg 26 of the inner strip 18 and the outer leg 26 of the outer strip 17. For this purpose, the cutout 29 extends in the region of intermediate layers, namely in the region of the inner leg 24 and of the intermediate leg 25 of the Z-fold strip 21 assigned to the outer strip 17.

Figures 5, 6, 7, 8:
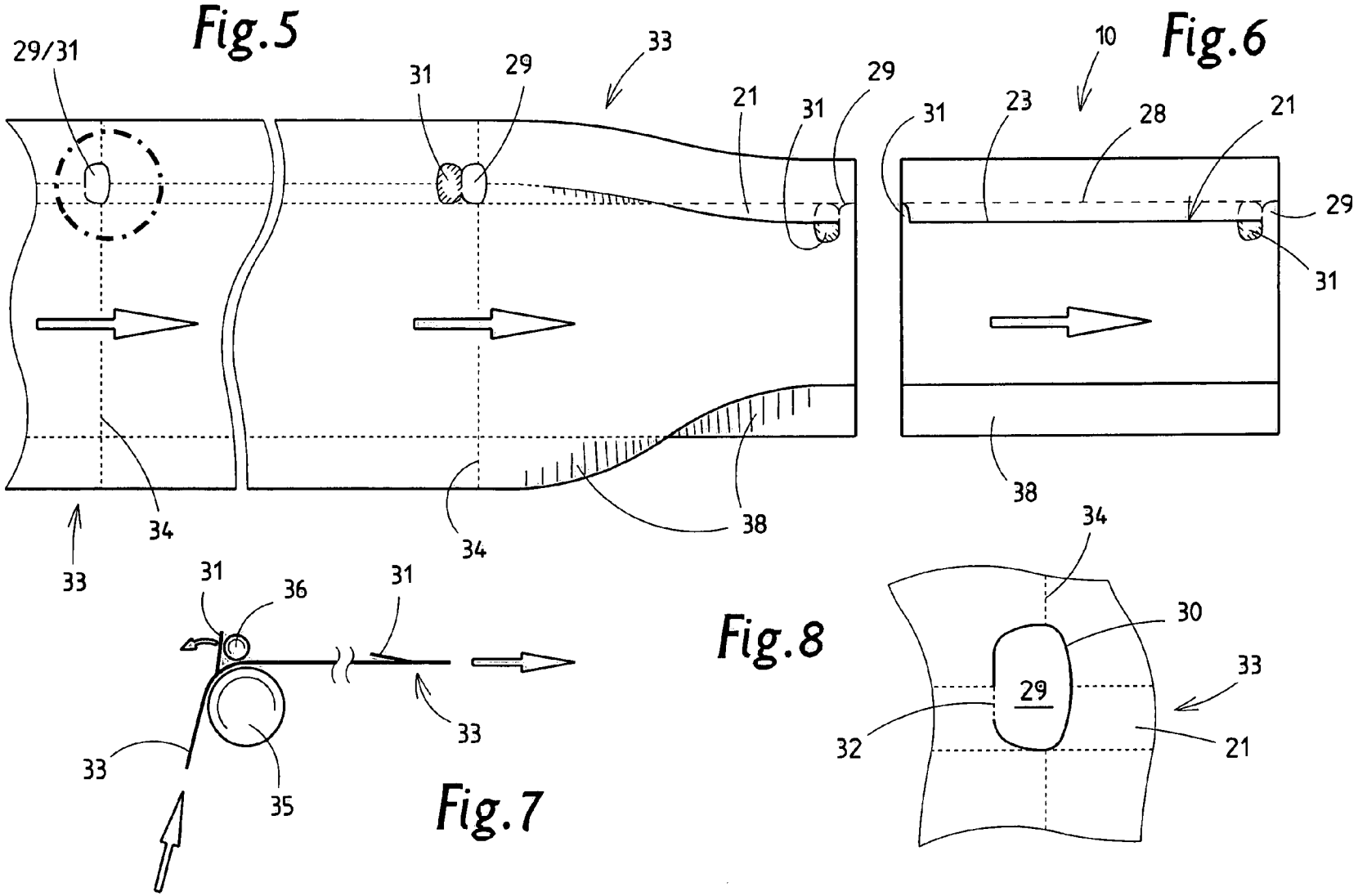
FIG. 5 shows a material-web section for producing blanks.
FIG. 6 shows a blank severed from the material web according to FIG. 5.
FIG. 7 shows a schematic side view of a material-web section according to FIG. 5.
FIG. 8 shows, on a vastly enlarged scale, a detail of the material web according to FIG. 5 in the region of a punch cut.
Figure 9:
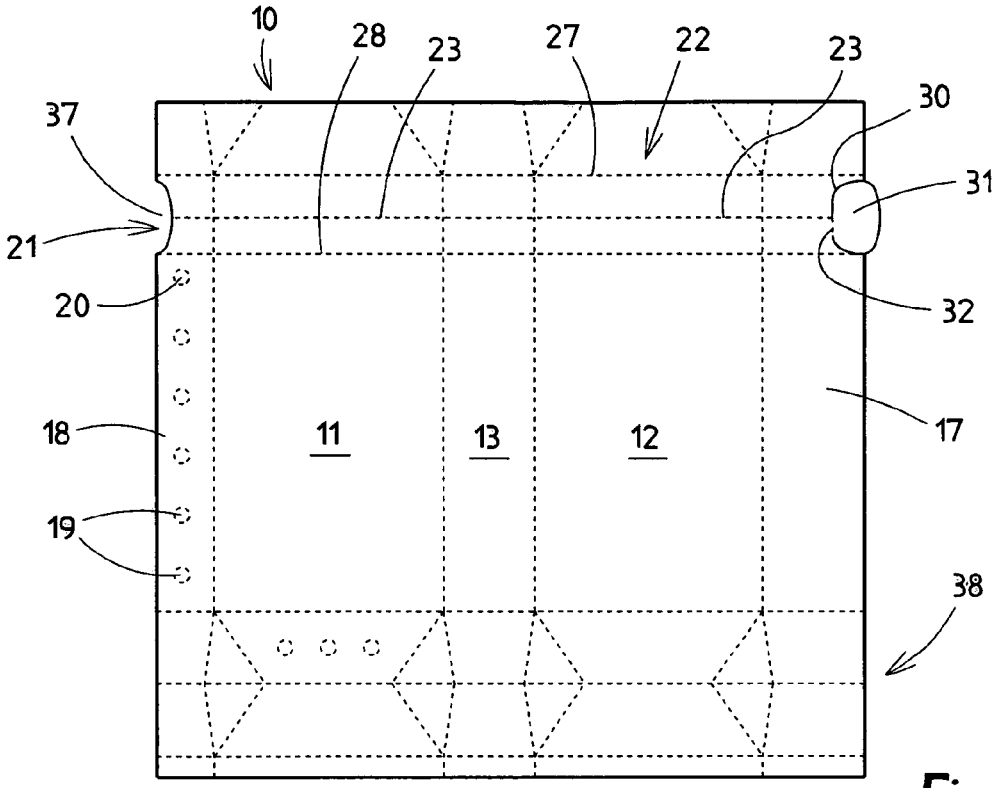
FIG. 9 shows a finished blank without a folding strip.

The cutout or opening 29 is designed and arranged in a specific manner. As can be seen from FIG. 8 in particular, the cutout or opening 29 is enclosed (bounded) in its entirety by a rounded contour or periphery, namely by a corresponding round punch cut 30. This is elongate, more or less oval, in the direction transverse to the Z-fold strip 21.

Figure 10:
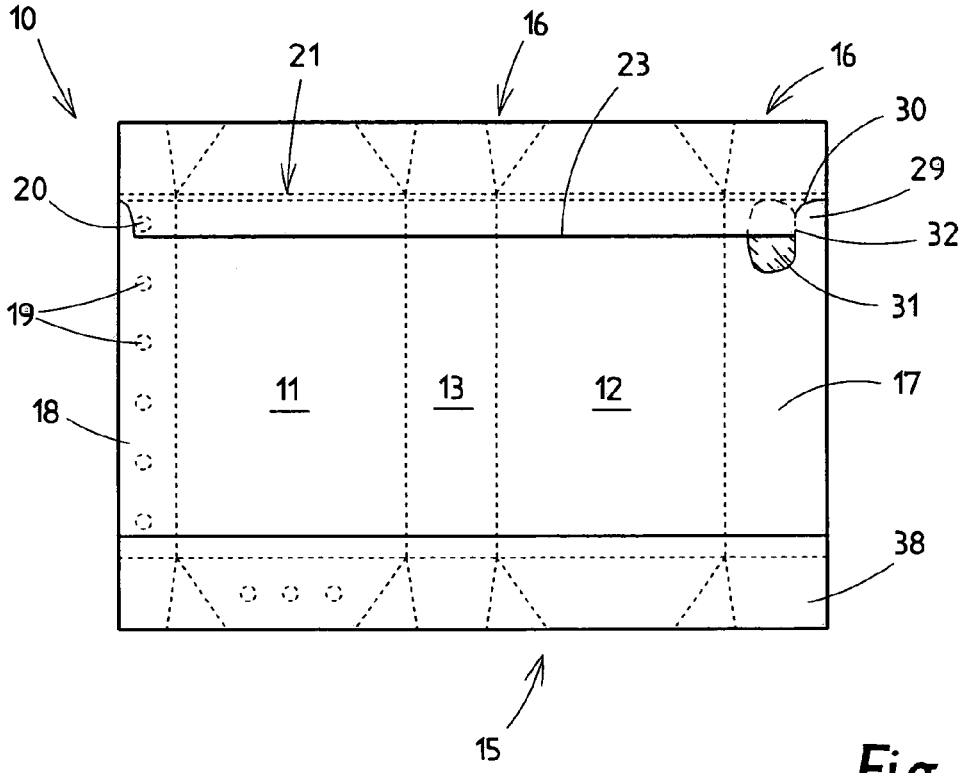
FIG. 10 shows the blank according to FIG. 9 once the folding strip has been made.

A further special feature is that a piece of material or punched segment 31 severed by the punch cut 30 remains connected to the blank 10 via one or more residual connections 32. In order to release and/or to form the cutout 29, the punched segment 31 is folded over, with the result that it butts against the inside of the blank 10 alongside the cutout 29 (FIG. 10). The cutout 29 is located at the border of the blank 10, namely the outer strip 17, and extends approximately over the entire width of the Z-fold strip 21, that is to say it covers the inner leg 24 and intermediate leg 25 of the Z-fold.

A further special feature is constituted by the production of a blank 10. The blanks 10 are severed from a continuous material web 33. First of all, the punch cuts 30 are made in the planar material web 33, to be precise in an exact position in relation to the blank 10 which is to be produced. The punch cuts 30 are preferably made in each case in the region of the transversely directed severing cut 34 which is carried out subsequently (illustrated as a transversely directed perforation line). The punch cuts 30 are located outside the centre of the material web 33, namely in the region of the Z-fold strip 21 which is to be produced. The punching is positioned such that, as seen in the conveying direction of the material web 33, the residual connection 32 is located to the rear of the cutout 29. The punch cut 30 is configured such that, in this region, a rectilinear, transversely directed section is formed in order to provide a corresponding folding line when the punched segment 31 is folded over.

Following the punching, during the conveying movement, the punched segment 31 is folded out of the region of the cutout 29, to be precise counter to the conveying direction of the material web 33, until it butts against the material web 33. For this purpose, a specific folding measure is taken, and this can be gathered from FIG. 7 in particular. The material web 33 is deflected in this region, to be precise in this case about an obtuse angle over a deflecting roller 35. The material web 33 follows the contour of the deflecting roller 35, while, on account of the material properties, the punched segment 31 is directed transversely and/or approximately tangentially. A stationary folding element, in this case a folding roller 36 arranged above the material web 33, automatically folds over the punched segment 31 counter to the conveying direction, as a result of the relative movement of the material web 33, into a rearwardly directed position.

As it is conveyed further, the material web 33 is then provided with the folding strip 21, namely the Z-fold. Thereafter, the blank 10 is divided off from the material web 33 by the severing cut 34, the severing cut 34 being made eccentrically through the cutout 29. This results in a small sub-cutout 37 on the rear side of the blank 10 in the region of the Z-fold strip 21.

The blank 10 is then folded around the pack contents, the adhesive connection being produced in the region of the side wall 14.

In the present exemplary embodiment, the region of the base wall 15 is of double-layered design, to be precise on account of a double-layered border strip 38 of the blank 10. This border strip is likewise provided in the region of the material web 33, to be precise at the same time as the Z-fold.

LIST OF DESIGNATIONS

10 Blank
11 front wall
12 rear wall
13 side wall
14 side wall
15 base wall
16 end wall
17 outer strip
18 inner strip
19 spot of glue
20 spot of glue
21 z-fold strip
22 blank strip
23 z-fold edge
24 inner leg
25 intermediate leg
26 outer leg
27 folding line
28 folding line
29 cutout
30 punch cut
31 punched segment
32 residual connection
33 material web
34 severing cut
35 deflecting roller
36 folding roller
37 sub-cutout
38 border strip

What is claimed is:

1. A cigarette pack having a blank (10) which encloses the pack contents, which is made of foldable packaging material selected from the group consisting of paper, film and cardboard, which is of multi-layered design in a sub-region, and which, as a result of folding, has a folding strip all the way around the pack, including a Z-fold strip (21) with an inner folding tab connected to an outer folding tab by glue passing through an opening (29) in an intermediate tab, wherein:

a) the opening (29) is bounded by a punch cut (30) having a contour which is rounded overall;

b) the contour is open at a folding edge of the intermediate tab, and includes a punched segment (31) severed by the punch cut and remaining connected to the blank by one or more residual connections (32); and c) a glue spot (20) is positioned at the inner folding tab in an area of the opening (29).

2. A cigarette pack having a blank (10) which encloses the pack contents, which is made of foldable packaging material selected from the group consisting of paper, film and cardboard, which is of multi-layered design in a sub-region, and which, as a result of folding, has a folding strip all the way around the pack, including a Z-fold strip (21) with an inner folding tab connected to an outer folding tab by glue passing through an opening (29) in an intermediate tab, wherein:

a) the cutout (29) is made in the blank (10) by punching into a longitudinally extending continuous material web (33) of the packaging material by a transversely directed severing cut (34), b) the material web (33) is folded continuously in the longitudinal direction in order to form a folding strip (21), c) the severing cut (34) for producing the blanks (10) runs through the cutout (29) with open sub-cutouts of different sizes being formed at one border of the blank (10), and d) the blank (10) is folded about the pack contents in such a way that the cutout (29) is positioned in the folding strip (21) as intermediate tab being part of the outer folding tab.

3. A cigarette pack having a blank (10) which encloses the pack contents, which is made of foldable packaging material selected from the group consisting of paper, film and cardboard, which is of multi-layered design in a sub-region, and which, as a result of folding, has a folding strip all the way around the pack, including a Z-fold strip (21) with an inner folding tab connected to an outer folding tab by glue passing through an opening (29) in an intermediate tab, wherein:

a) the cutout (29) in the intermediate tab is bounded by a contour (30) which is rounded overall, b) the cutout (29) is oval, and elongate in a vertical direction of the pack, and c) the cutout (29) is open at a folding edge (23) of the intermediate tab (25) of the blank (10) and is formed from a closed cutout (29) by severing the blank (10) from a material web (33) by a severing cut through the closed cutout (29).

4. The pack according to claim 1, characterized in that the opening (29) is oval, and elongate in a vertical direction of the pack.

5. The pack according to claim 1, characterized in that the blank (10) has the opening (29) in a region of an outer strip (17) for forming a pack side wall (14).

6. The pack according to claim 2, characterized in that a piece of material or punched segment (31), which has been punched out of the blank (10) by the punch cut (30) in order to form the opening (29), is connected to the blank (10) via a residual connection (32) and is folded out of the region of the opening (29).

* * * * *